US009096298B1

(12) United States Patent
Alvarez

(10) Patent No.: US 9,096,298 B1
(45) **Date of Patent: *Aug. 4, 2015**

(54) RESCUE POLE

(71) Applicant: Arthur Alvarez, Birchwood, WI (US)

(72) Inventor: Arthur Alvarez, Birchwood, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/875,054

(22) Filed: May 1, 2013

(51) Int. Cl.
*B63C 9/00* (2006.01)

(52) U.S. Cl.
CPC ..... *B63C 9/00* (2013.01)

(58) Field of Classification Search
CPC ..... B63C 9/00; A01K 15/003
USPC ..... 441/80; 114/221 R; 294/191, 209, 175, 294/181; 119/807
See application file for complete search history.

(56) References Cited

U.S. PATENT DOCUMENTS

| | | | | |
|---|---|---|---|---|
| 409,478 | A | 8/1889 | Lucky | |
| 1,002,709 | A | 9/1911 | Kromann | |
| 1,056,343 | A | 3/1913 | Kromann | |
| 1,344,828 | A * | 6/1920 | Simantel | 119/807 |
| 2,122,264 | A | 6/1938 | Porter | |
| 2,485,703 | A | 10/1949 | Christoffer | |
| 3,841,685 | A | 10/1974 | Kolodziej | |
| 3,978,605 | A | 9/1976 | Maruniak | |
| 4,519,643 | A | 5/1985 | Harris | |
| 4,580,825 | A | 4/1986 | Johnson | |
| 4,599,074 | A | 7/1986 | Beckly | |
| 4,834,437 | A * | 5/1989 | Howard, Sr. | 294/110.1 |
| 4,845,876 | A | 7/1989 | Dodson | |
| 5,003,907 | A | 4/1991 | Roach et al. | |
| 5,058,306 | A | 10/1991 | Sienel | |
| 5,116,093 | A | 5/1992 | Burns | |
| 5,494,240 | A | 2/1996 | Waugh | |
| 5,752,731 | A | 5/1998 | Crone | |
| 5,799,602 | A | 9/1998 | Trillo | |
| 6,067,942 | A | 5/2000 | Fernandez | |
| 7,029,353 | B2 | 4/2006 | Goodman et al. | |
| 7,246,575 | B2 | 7/2007 | Goto | |
| 8,360,813 | B1 * | 1/2013 | Alvarez | 441/80 |

* cited by examiner

*Primary Examiner* — Edwin Swinehart
(74) *Attorney, Agent, or Firm* — Anthony J. Bourget

(57) ABSTRACT

A rescue pole includes a clamping mechanism secured to a pole. In one aspect the rescue pole has a hollow body with exterior sections connected by sidewalls. A pair of opposed curved arms extend from the hollow body and pivot to close and separate from each other. A pulley is mounted on the body between the curved arms opposite the pole. First and second rope members secured to a drive mechanism operate the curved arms. Pulling one rope moves apart the exterior attached arms. Pulling another rope moves the arms toward each other.

20 Claims, 13 Drawing Sheets

RESCUE POLE

BACKGROUND OF THE INVENTION

1. Field of the Invention

The present invention relates to a rescue pole device, and more particularly, to a rescue pole device having a clamping end, and most particularly, to a rescue pole and clamp device useful for rescuing an individual that is in the water or has fallen through the ice into water.

2. Background Information

When an individual has fallen in the water and is in need of assistance to be rescued, a number of devices are available to assist rescuers in this task. In warmer climates, a wide variety of rescue devices can be employed, including a simple pole, a ring buoy on a rope, a life vest, a nearby boat or canoe, etc. The situation is more complex in cold climates where the water is much colder and may be covered by ice. Although the danger of drowning is present in both situations, an individual in icy water must contend with hypothermia as well. In warmer water situations, the individual may be able to assist rescuers in moving the individual to safety. An individual subjected to icy water quickly loses the ability to work with rescuers to aid in their transport to safety. Consequently, a device for icy water rescues must be able to engage an individual in distress without that individual's assistance. Such a situation often occurs when an individual has fallen through thin ice on a body of water. In this situation, the rescuer dare not closely approach the individual in distress, lest the rescuer also break through the ice. A number of devices having a feature for engaging an individual, an animal or an object have been granted patents.

Kromann, in U.S. Pat. No. 1,002,709, describes a spring-loaded harpoon device having a pair of arms with curved ends. The arms are pivotally anchored at one end to a handle and each anchored end has gear teeth, which engage a toothed shaft. A spring around the handle moves the shaft out from the handle with the shaft, which pivots the anchored ends of the arms. This pivoting causes the curved ends of the arms to converge and encircle or impale an object In U.S. Pat. No. 1,056,343, Kromann discloses another spring-loaded harpoon device having a pair of scissors arms with curved ends. Actuating the device causes the scissors arms to extend and the curved ends to close on an object and impale or securely hold the object with the curved ends of the scissors arms Porter, in U.S. Pat. No. 2,122,264, describes a noose device that includes a long and slender body part with the animal-engaging section at one end and the manipulating and extension-connecting section at its opposite end. The opposite end is held by the operator, and the engaging section includes a mechanism to open for admittance of the animal and close for its retention. The animal-engaging section is made up of hollow curved fork members rigidly secured to the end of the body part, which also is hollow, and curved closure members are slidable inward and outward in the hollow fork members. The fork members have on their outer ends ball-like enlarged projections, which are adapted for avoiding injury to the animal as they pass at opposite sides of its neck or body. The closure members slide to their inner positions in the respective fork members, and then pass around the neck or body of the animal to their outer closing positions. The closure members also are hollow, with the terminal balls fixed by necks inside their outer ends and provide the outer-end-abutments for respective open-coil springs contained within the closure members. These springs are compressed between the outer and inner abutments when the closure members are moved inward, and tend to force these members outward to the closing position unless held by retaining means. The retaining means comprises slender but strong cables with their outer end parts fixed in the necks of the respective ball terminals In U.S. Pat. No. 2,485,703, Christoffer discloses an improved livestock tool that includes a body having clamp arms pivoted on the lower end thereof, and adapted to support a cable loop. The body contains a handle operatively connected with the clamp arms for automatically moving the clamp arms to tighten the cable loop about the snout of the animal when caught. The loop is removable so that the tool may be used as a bull stop or cattle leader by engaging the clamp arms in the nostrils of the animal or in a ring already in the animal's nose.

Kolodziej, in U.S. Pat. No. 3,841,685, describes a line holding and manipulating device that includes a pair of flexible arms, which define arcs of the same radii and of less than 180.degree. length. The flexible arms describe a circle having a gap between oppositely disposed ends of the arms. The arms are hollow in nature, are slotted along their entire length and are supported in such a manner as to cause the slots to face inwardly toward the center of the circle. A loop at the end of a line may be supported within the hollow flexible arms prior to engagement with an object.

In U.S. Pat. No. 3,978,605, Maruniak discloses a cheliform fish grip having an overall specific gravity of less than that of water. The device is obtained by constructing the parts of a plastic having a specific gravity greater than 1.0, and constructing the handle with an air compartment of sufficient size to reduce the overall specific gravity to less than 1.0. The jaws of the fish grip are pivotally mounted on a body, an actuator is slidably mounted in the body and spring biased levers are pivotally connected to the actuator and to a central portion of each jaw.

Harris, in U.S. Pat. No. 4,519,643, describes a rope handling device comprising two cylindrical tubes adapted to have one pass longitudinally within the other, with a T or Y shaped journal attached to the end of the outer tube. An appropriate length of rope is positioned through the length of the inner tube and the rope is looped at the end extending out of the tubes and through a spreading journal or yoke. One portion of the loop extends out one side of the journal, and another part extends out the other side of the journal, and the completion of the loop extends out beyond the journal. The loop section of the rope has a stiffening means, such as a stiff spring wire embedded and securely fastened in the rope. The loop may be enlarged by pushing the rope through the spreader. The loop may be made smaller and tightened on any object encircled by the loop by pulling the rope through the tubes. By pulling the inner tube away from the loop, the overall length of tubes may be expanded to a considerable length to permit positioning the loop over an object a considerable distance from the holder. The device is particularly adapted for fastening boats to mooring posts.

In U.S. Pat. No. 4,580,825, Johnson discloses an apparatus for extricating an individual from a hazardous location or situation. The apparatus includes a mechanism for selectively grappling various portions of the individual's body and a generally elongated frame having a substantially longitudinal extent which can be varied in length and which supports the body grappling mechanism. The elongated frame allows an individual to use the grappling mechanism to grapple a portion of the body of the individual who is in a jeopardized situation from a position of safety without jeopardizing both individuals. The body grappling mechanism includes a torso engaging mechanism and a limb engaging mechanism, both of which extend outwardly from the longitudinal axis of the frame of the apparatus. The torso engaging mechanism is contoured to define at least one torso receiving concavity having a lateral extent, with respect to the frame, which is selectively sized and configured to receive and retain the torso of an average individual. The limb engaging mechanism is contoured to define at least one limb receiving concavity having a lateral extent, with respect to the frame, which is selectively sized and configured to receive and retain at least one limb of an average individual. The lateral extent of the limb receiving concavity is less than the lateral extent of the torso receiving concavity. Depending upon the hazardous situation in which the apparatus is to be utilized, the entire apparatus may be formed from electrically insulating materials and/or chemically resistant materials.

Beckly, in U.S. Pat. No. 4,599,074, describes a man-overboard retrieval device that includes a rigid, tubular boom attachable at an inboard end to an anchorage on a boat. At its other, outboard end, a strap forms a semi-rigid, self-supporting bight, which can be placed around a man in the water. A draw-cord attached to a free end of the strap extends through the boom and emerges at the inboard end where it can be pulled to tighten the bight around the man before being fastened in a cleat. A hoist on the boat can be attached to a hoisting eye on the boom either at the inboard end or near the strap, as convenient, for hoisting the device and the rescued man onboard.

In U.S. Pat. No. 4,845,876, Dodson discloses a self-activated gaff, which responds to contact of a trigger bar with an object to cause a pair of tongs to close and embrace the object and to lock around the object until released. The gaff uses a piston-like member and a pair of constant force springs to couple the piston-like member to the tongs. The tongs may subsequently be released by the manual release of the tong-locking mechanism.

Roach et al., in U.S. Pat. No. 5,003,907, describe a mooring and maneuvering device, which includes an elongated rigid pole, having an improved boat hook at the distal end. A flexible loop is attached at the distal end and moves to an operative position to facilitate the securing of the device to a mooring post. In an inoperative position, the loop is pivoted back upon and secured to the pole to permit the use of the device for other purposes.

In U.S. Pat. No. 5,116,093, Burns discloses an apparatus for moving an individual. The apparatus includes a fitting attached to one end of a pole. The fitting is shaped and dimensioned to engage an individual's clothing by being pressed against the clothing and rotated. The apparatus can be fitted with various hooks and/or straps to engage the appendages or body of an individual in need of rescue.

Waugh, in U.S. Pat. No. 5,494,240 describes a recovery device for use from the cargo door of a helicopter hovering over a vehicle to be recovered. The device includes a telescoping pole with an upper end secured to the helicopter floor and a lower end defining a hoop which can be manipulated around the weapon or target into a first position for securing a first noose to a first portion of the vehicle to be recovered. The snare pole is then shifted to a second position where a second noose is tightened around a second portion of the vehicle. After the nooses have been positioned about the vehicle, the crewman aboard the helicopter pulls the retainer lanyard joined to the retaining pins. This operation releases the snare pole from the helicopter. The inner pole telescopes within the outer pole, and the vehicle is held directly beneath the helicopter by the cargo hook. The pilot can then fly the helicopter upwardly to carry the vehicle clear of the water.

In U.S. Pat. No. 5,752,731, Crone discloses victim snare pole that includes a substantially stiff, elongated member having two opposing ends, on at least one end of which are provided a rearward facing hook and a non-sliding snare loop. Other feature(s) such as light(s) may be provided. In a preferred embodiment, the pole is substantially non-reactive with respect to the victim and the surrounding area where a rescue would be attempted. A victim may be rescued by a rescue operator by steps, which can include providing the victim snare pole to the rescue operator, and locating the victim; inspecting the victim and his surroundings, and discerning how to rescue him with the victim snare pole. The actions are selected of; hooking and pulling the victim back in the direction of the rescue operator employing the hook of the pole; securing the victim with the non-sliding snare loop by causing the non-sliding snare loop to surround a part of the victim; followed by twisting the victim snare pole to tighten the non-sliding snare loop around that part of the victim and then pulling him back in the direction of the rescue operator.

Trillo, in U.S. Pat. No. 5,799,602, describes a docking fork for facilitating the placing of a docking line loop about an object, such as a piling or cleat, to assist in the docking of a marine vessel. The docking fork includes a substantially U-shaped tray member defining upstanding walls and a floor for receiving and maintaining a docking line loop in an open condition in preparation for positioning about the object. The docking fork, supporting the docking line loop, is placed over a piling and is pulled away, thus leaving the docking line loop alone about the object in preparation for tightening and subsequent docking of the vessel.

In U.S. Pat. No. 6,067,942, Fernandez discloses a device for capturing an aquatic animal, such as a fish, particularly for ensnaring the tail or body of a fish. The invention relates to a device, which places a rope around the body or tail of any fish. The device comprises a pole having a circular tube attached at one end of the pole. A rope is removably attached to the inside of the tube such that when the rope is pulled on, it is removed from the attachments of the tube and ensnares the body or tail of the fish. The rope has an open end on one end and a noose at the other end.

U.S. Pat. No. 7,029,353 by Goodman et al. discloses a system and method involving a line capture device and a flotation apparatus. The line capture device has a body, at least one line retainer having a line retainer portion and a latching portion for retaining a portion of a captured line. A capturing line extends from the body for pulling the device. The captured line and a secondary object, such as a victim, can be pulled back to a rescuer. The flotation apparatus has a safety flotation vest housing a deployable flotation device and a deployable line to be captured.

Goto, in U.S. Pat. No. 7,246,575, describes a thrust fork to arrest a resisting criminal without danger of being stabbed by an edge tool. A thrust fork's main body is attached to an end of a handle portion provided with a forked rod. Movable opening and closing rods have base end portions pivoted to leading ends of the forked rod and freely swivel only inside the forked rod without outward movement. A returning element returns the opening and closing rods by a spring to an original position. A constraining rope, both ends of which are engaged with leading ends of the opening and closing rods respectively, forms a ring having a suitable size inside the forked rod. The end of the forked rod is opened and closed via swiveling of the opening and closing rods.

While the foregoing devices may be beneficial, there is always room for improvement.

SUMMARY OF THE INVENTION

The invention is directed to a rescue pole having a clamping mechanism at one end. The rescue pole is telescoping in structure. It may extend to a variety of lengths, including a length of at least about 24 feet. At one end of the pole is mounted a clamping mechanism that is designed to encircle and/or grasp the body of an individual, particularly an individual that has broken through the ice and requires rescue. The device may also be used to rescue an individual in other settings.

In one aspect the clamping mechanism includes a pair of curved arm members each with an attachment section at one end. Each attachment section is pivotally secured at one end to a drive mechanism positioned within a body member, which is rigidly mounted to the end of the telescoping pole member. A guide pin is positioned on the attachment section of each curved arm member. The body member includes a roller or pulley at an edge opposite the pole member. A pair of ropes or cables is attached to the drive mechanism and extends the full length of the extended pole member. A first rope member is attached to the drive member and loops around the roller or pulley on the body member, and extends back down the pole member. A second rope member is attached to the drive mechanism and extends within the body member, directly back down the pole member. The curved arm members and the end portion of the body member include flotation coverings, such as Styrofoam® or similar buoyant material, to float the clamping assembly on the surface of the water. The first rope member and second rope member may have diameters of varying thickness. For instance, the rope used to open the arms may be smaller or have a smaller diameter, while the rope used to close the arms and pull the victim to safety may have a larger diameter by comparison.

In use, the telescoping pole member may be extended fully and is used to manipulate the clamping end of the assembly to an individual in the water or otherwise in need of assistance. In one aspect, pulling on the second rope member, the drive mechanism moves toward the pole member with the guide pins traveling toward each other within the slots of the guide plate member. This movement causes the curved arm members to pivot about the guide pin members and close around the torso of the individual in the water. Then the second rope member is used to pull the individual to safety, while the telescoping pole is used only to position the clamping mechanism. Should the individual slip from the grasp of the curved arm members, the arm members can be reopened wide by pulling on the first rope member. The first rope member, which is looped around the roller or pulley of the body member, reopens the curved arm members for another attempt to grasp the torso of the individual.

A method of rescuing a person utilizing the rescue pole is also included.

The above summary of the present invention is not intended to describe each illustrated embodiment, aspect, or every object or implementation of the present invention. The figures and detailed description that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
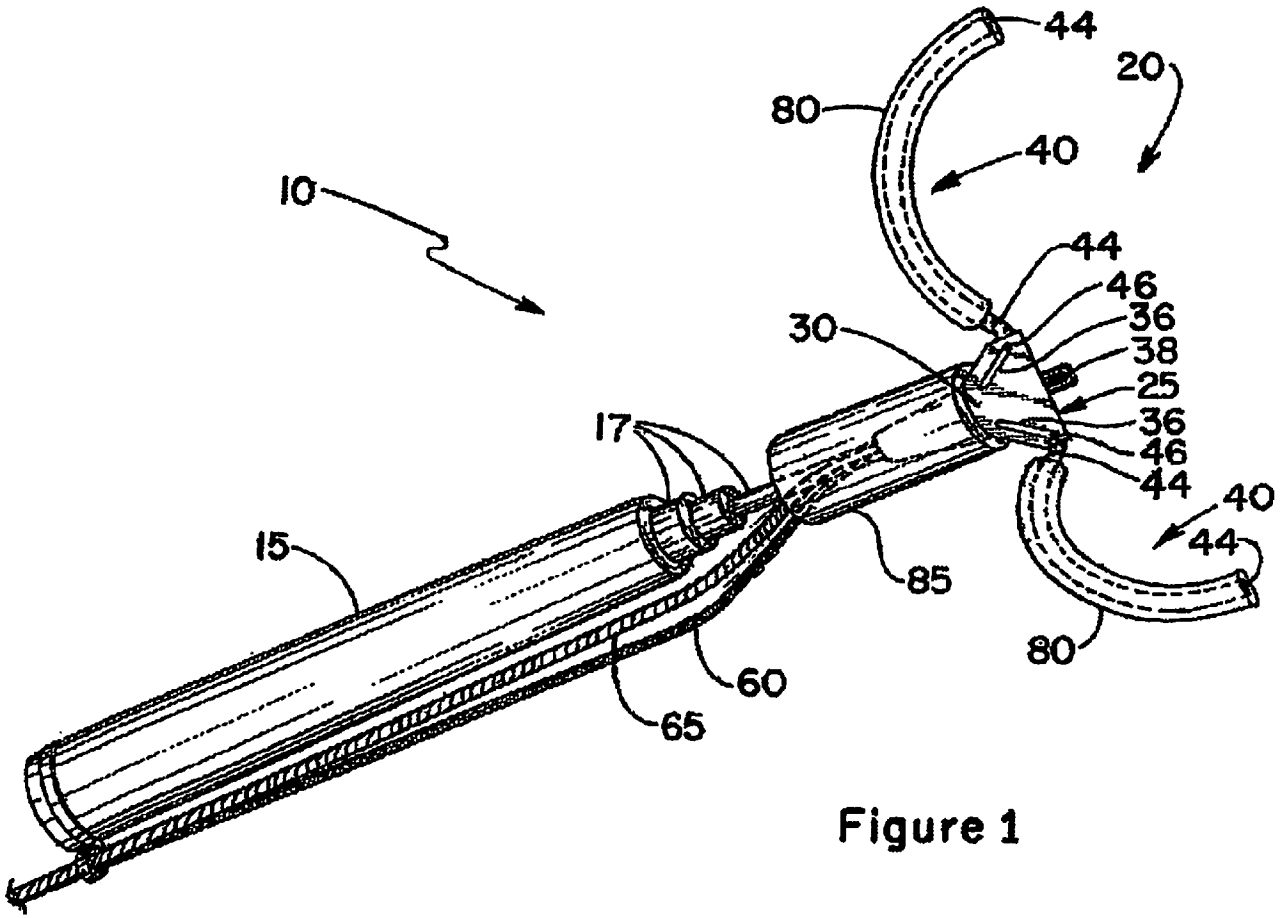
FIG. 1 is a perspective view of the rescue pole of the present invention with the clamping mechanism in an open condition.

While the invention is amenable to various modifications and alternative forms, specifics thereof have been shown by way of example in the drawings and will be described in detail. It should be understood, however, that the intention is not necessarily to limit the invention of the particular embodiments described.

DETAILED DESCRIPTION OF THE INVENTION

The following detailed description is not to be taken in a limiting sense, but is made merely for the purpose of illustrating the general principles of the invention, since the scope of the invention is best defined by the appended claims.

The invention is a rescue pole comprising a linear pole member disposed at one end with a clamping mechanism. In one aspect the clamping mechanism includes a body member having opposed planar sections in register connected by sidewall sections to form a hollow interior. A pole connector member is positioned at one edge of the body member, with the pole connector member attached to said end of the linear pole member. A pair of opposed curved arm members extends from interior the hollow body member. Each arm member includes a pin member positioned interior the hollow body member. In one aspect each pin member extends through both of a pair of aligned, linear slots in the opposed planar sections of the body member, with each pair of aligned slots converging toward the pole connector member. A drive mechanism within the hollow body member is pivotally secured to an attachment end of each curved arm member there within. A pulley member is rotatably mounted at an edge of the hollow body member opposite the pole connector member and between the pair of opposed curved arm members. First and second rope members are each secured to the drive mechanism. The first rope member encircles or partially loops upon the pulley member and extends from the body member. The second rope member extends from interior the body member directly from the drive mechanism and adjacent the pole connector member. Pulling the first rope member draws the drive mechanism and attachment end of each curved arm member toward the pulley member with the pin members in the linear slots moving to spread apart the attached arm members exterior the body member. Pulling the second rope member draws the drive mechanism and attachment end of each curved arm member toward the pole connector member, with the pin members in the linear slots moving to bring together the attached arm members exterior the body member.

Figure 2:
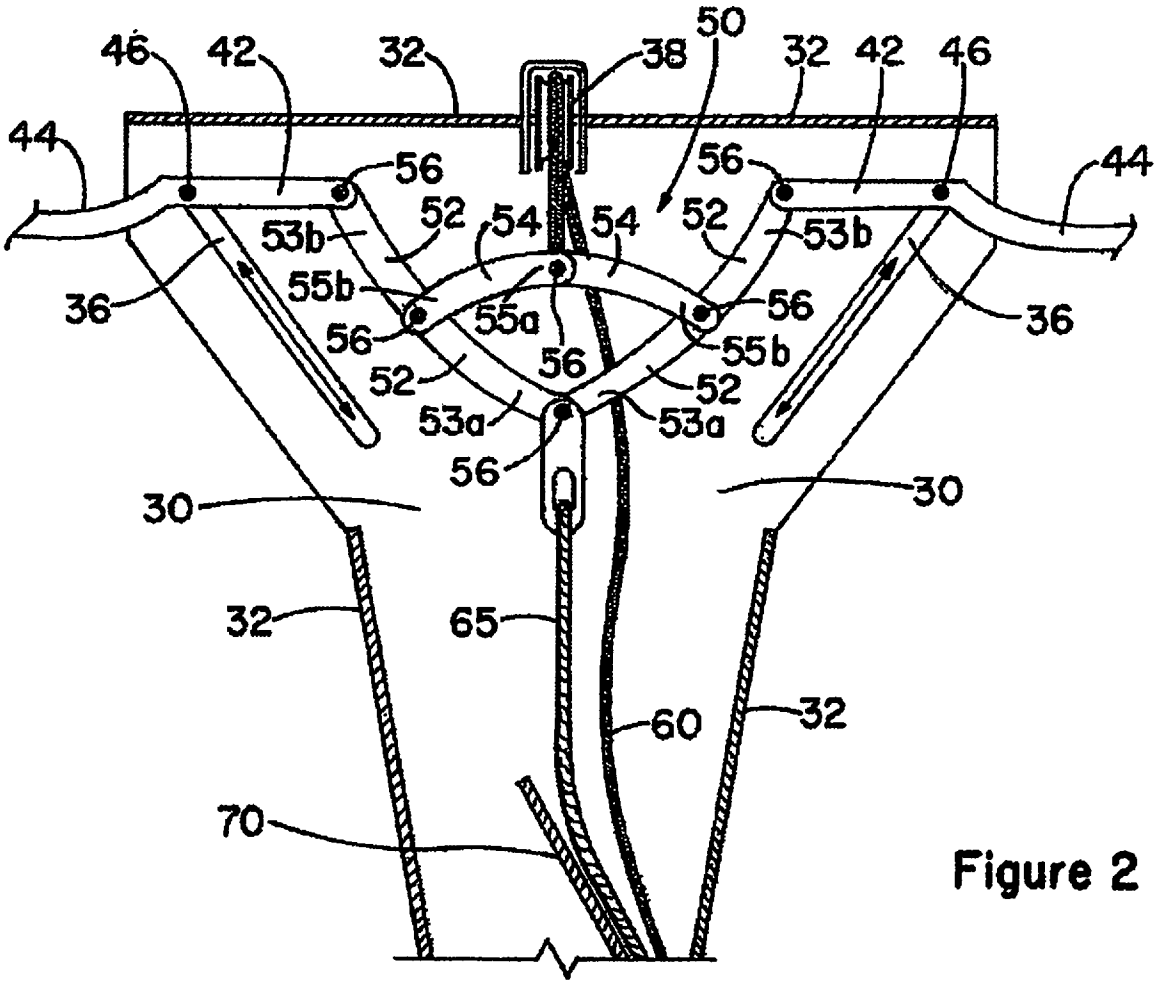
FIG. 2 is a top view of a part of the clamping mechanism portion of the present invention in an open condition with one planar portion of the body member removed.
Figure 6:
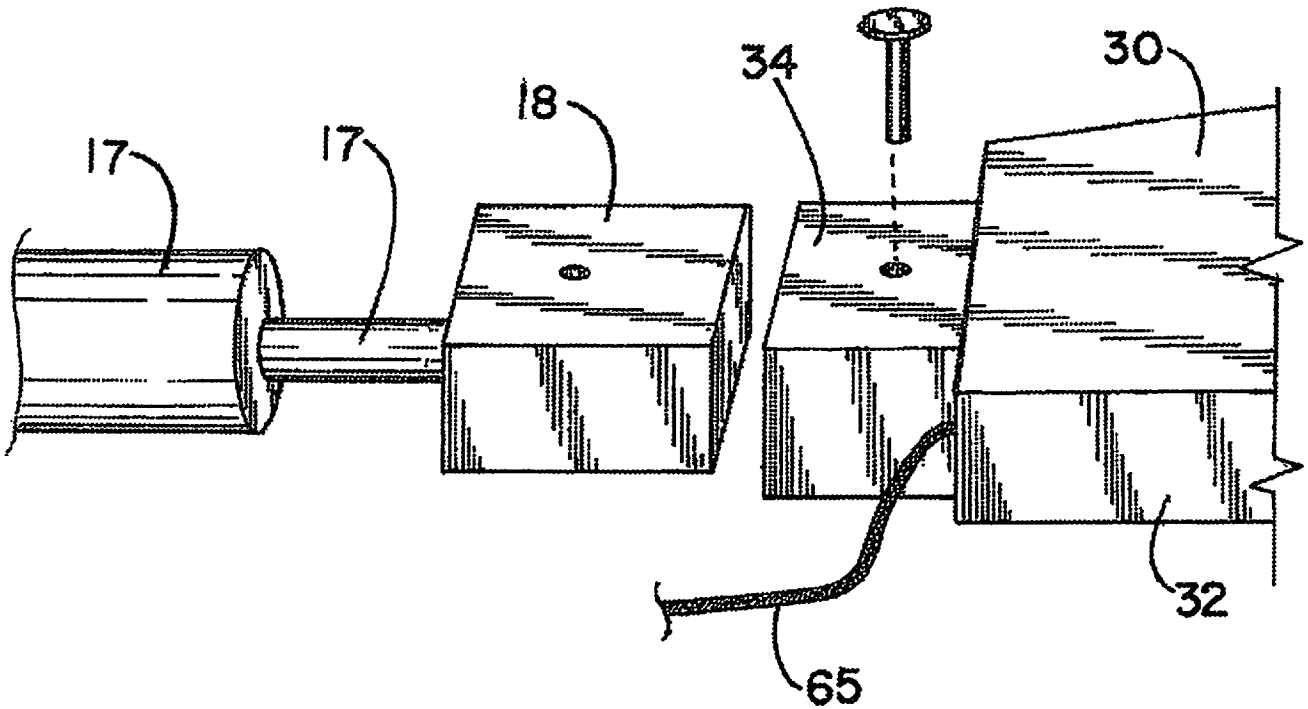
FIG. 6 is a perspective view of a portion of the rescue pole showing aspects of the invention.

Referring now to FIGS. 1 and 2, a first aspect of the rescue pole 10 is shown. The rescue pole 10 comprising a linear pole member 15 secured at one end by a connector 18 to a clamping mechanism 20. In one aspect the linear pole member 15 is telescoping and fabricated with telescoping sections 17 to allow lengthening of the pole member 15 as needed. The clamping mechanism 20 includes a body member 25 having opposed planar sections 30 positioned in register and connected by sidewall sections 32 to form a hollow interior. The sidewall sections 32 are not continuous, thereby providing several openings into the hollow interior. A plan view of the body member 25 with one of the planar sections 30 removed is shown in FIG. 2. A pole connector member 34 is positioned at one edge of the body member 25, with the pole connector member 34 attached to the connector 18 at the end of the linear pole member 15, as illustrated in FIG. 6.

A pair of opposed arm members 40 extend from interior the hollow body member 25. The arm members 40 may be curved. The sidewall sections 32 of the body member 25 are not continuous and provide openings in the body member 25 for movement of the curved arm members 40. Each arm member 40 includes an attachment end 42 positioned interior the body member 25 and a curved end 44 positioned exterior the body member 25. In one aspect, the curved end 44 of each arm member 40 is encircled by a tight fitting flotation member 80 that is both buoyant and structurally strong. A suitable material for the flotation members 80, for instance, is a polystyrene polymer foam in a cylindrical form. It may be appreciated that other floatation material may be utilized. Each arm member 40 includes a pin member 46 in the attachment end 42 that also is positioned interior the hollow body member 25. In one aspect, each pin member 46 extends through a pair of aligned, linear slots 36 each slot in one of the opposed planar sections 30 of the body member 25, with each pair of aligned slots 36 converging toward the pole connector member 34.

A drive mechanism 50 or linkage within the hollow body member 25 is pivotally secured to the attachment end 42 of each curved arm member 40 there within. As shown in FIG. 2, the drive mechanism or linkage 50 comprises a pair of first pivoting arms 52 pivotally joined together at each first end 53*a* by a pivot point connector pin 56. Each first pivoting arm 52 is pivotally connected at a second end 53*b* to the attachment end 42 of one curved arm member 40 at a point interior to the pin member 46. Another pivot point connector pin 56 provides the connection. In addition, a pair of second pivoting arms 54 is pivotally joined together at each first end 55*a* by another pivot point connector pin 56. Each second arm 54 is pivotally connected at a second end 55*b* to a midpoint of, for instance, or between, one of the pair of first arms 52, again by another pivot point connector pin 56.

A pulley member 38 is rotatably mounted at an edge of the hollow body member 25 opposite the pole connector member 34 and between the pair of opposed curved arm members 40. It may be appreciated that pulley member 38 or mechanism may include a variety of pulley functioning devices, including, for example, a sleeve or roller or wheel that is positioned about a shaft so that the roller, sleeve or pulley may rotate. A first rope member 60 is secured to the linkage or drive mechanism 50 at the pivot point connector pin 56 connecting the first ends 55*a* of the pair of second pivoting arms 54. It may be appreciated that rope may be made of many different types of materials, including but not limited to cellulose fibers, nylon, plastic, or other materials. The first rope member 60 encircles, at least partially, the pulley member 38 and extends from the body member 25. A second rope member 65 is also secured to the linkage 50, but at the pivot point connector pin 56 connecting the first ends 53*a* of the pair of first pivoting arms 52. The second rope member 65 extends from interior the body member 25 directly from the drive mechanism 50 and outside the body member 25 adjacent the pole connector member 34, as illustrated in FIG. 6.

Pulling the first rope member 60 draws the drive mechanism 50 and the attachment end 42 of each arm member 40 toward the pulley member 38 with the pin members 46 in the linear slots 36 moving to spread apart the curved ends 44 of the attached arm members 40 exterior the body member 25, as illustrated in FIG. 1. FIG. 2 illustrates the position of the drive mechanism 50, the attachment ends 42 of the curved arm members 40 and the pin members 46 with the curved arm members 40 wide open.

Figure 3:
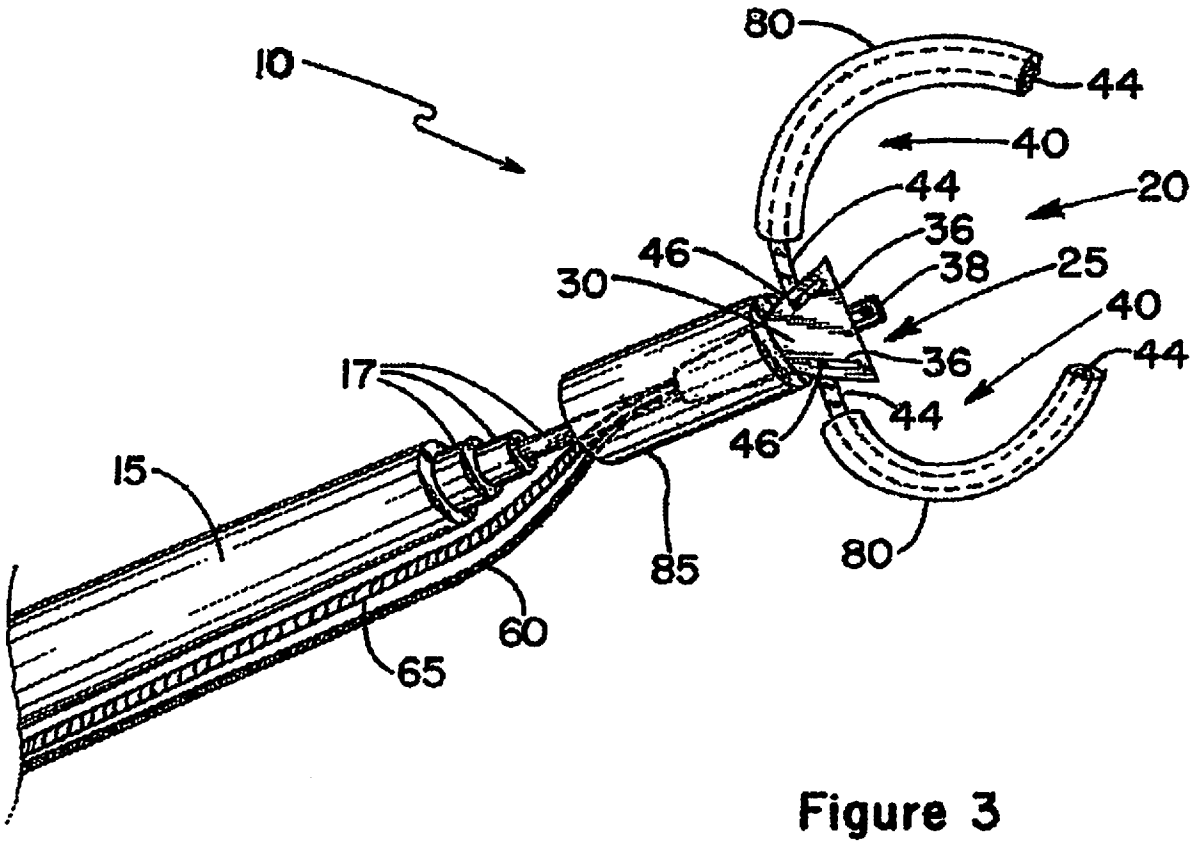
FIG. 3 is a perspective view of the rescue pole of the present invention with the clamping mechanism is a closed or closing condition.
Figure 4:
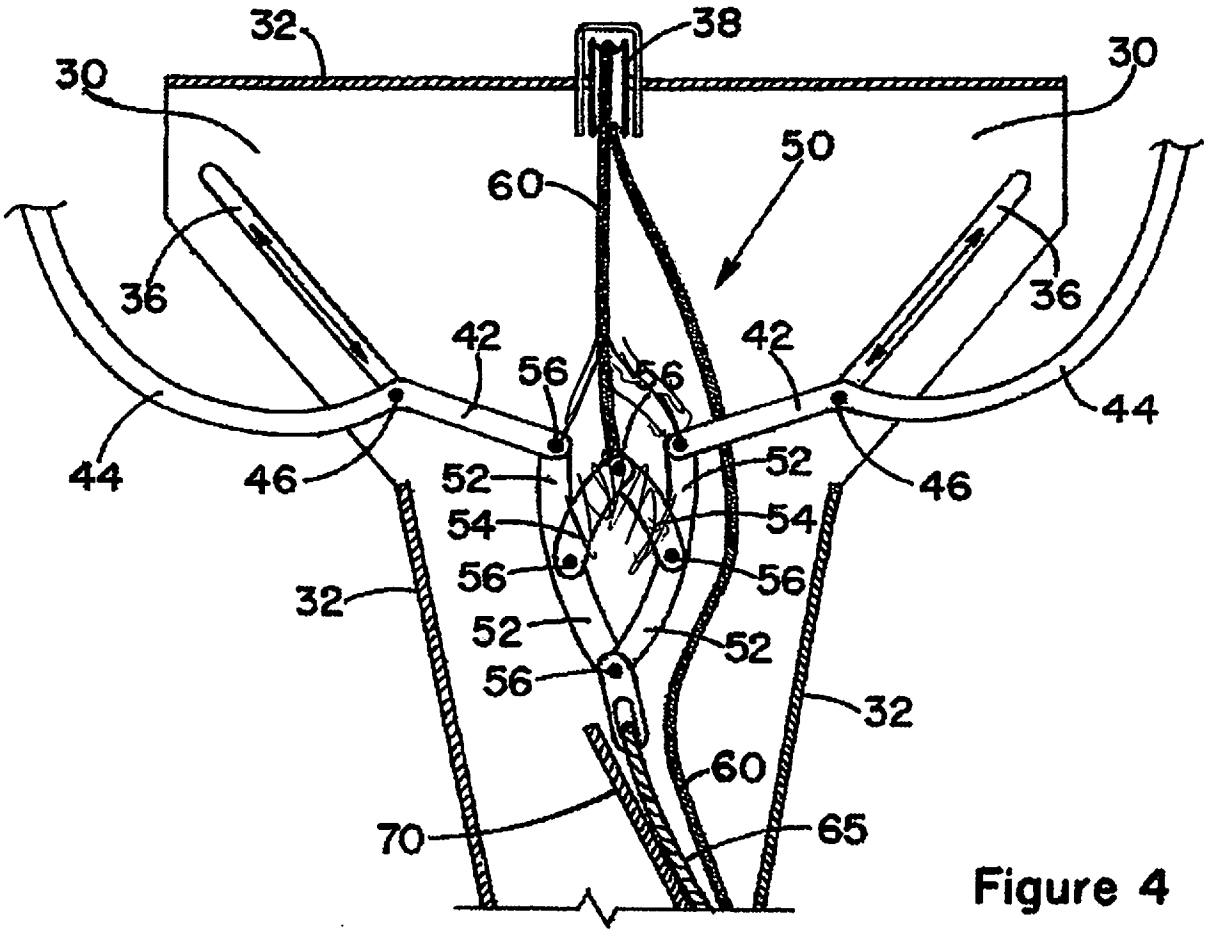
FIG. 4 is a top view of a portion of the clamping mechanism portion of the present invention in a closed or closing condition with one planar portion of the body member removed.

Pulling the second rope member 65 draws the drive mechanism 60 and the attachment end 42 of each arm member 40 toward the pole connector member 34, with the pin members 46 in the linear slots 36 moving to bring together the curved ends 44 of the curved arm members 40 exterior the body member 25, as illustrated in FIG. 3. FIG. 4 illustrates the position of the linkage or drive mechanism 50, the attachment ends 42 of the curved arm members 40 and the pin members 46 with the curved arm members 40 tightly (or at least partially) closed.

The first rope member 60 and second rope member 65 may have diameters of varying thickness. For instance, the rope used to open the arms (i.e., rope member 65) may be smaller or have a smaller diameter as compared to the rope used to close the arms and/or pull the victim to safety (i.e., rope member 65). An operator may then be able to distinguish between the different ropes. Additional distinguishing features may also be used, such as ropes of different colors, textures or other aspects. Further, a smaller rope may be sufficient to open the arms whereas a larger rope may be used to pull the victim which may require a greater force.

Figure 5:
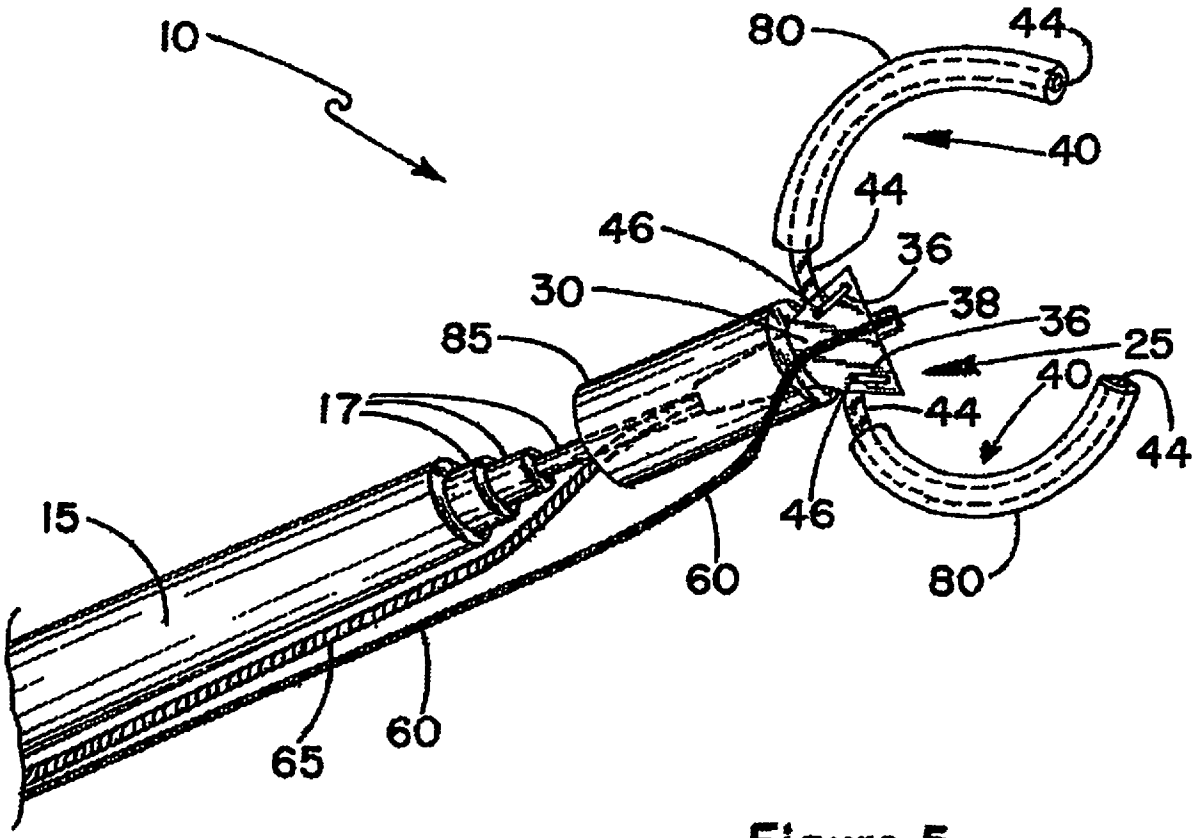
FIG. 5 is a perspective view of the rescue pole of the present invention with the clamping mechanism in a closed condition or closing condition and illustrating an alternative route for the rope to open the clamping mechanism.

The route of the first rope member 60 from the drive mechanism 50 to the end of the linear pole member 15 opposite the clamping mechanism 20 includes at least two options. As shown in FIGS. 1-4, the first rope member 60 encircles or partially encircles the pulley member 38 and is routed back through the hollow body member 25 and follows the route of the second rope member 65, exiting the hollow body member 25 adjacent the pole connector member 34. An interior partition 70 guides both rope members 60, 65 around the pole connector member 34 to the exterior of the hollow body member 25. Both rope members 60, 65 are routed within the flotation member 85 secured to the body member 25, as illustrated. Alternatively, as shown in FIG. 5, the first rope member 60 encircles or at least partially encircles the pulley member 38 and then extends exterior the hollow body member 25 and is routed back along the linear pole member 15.

In addition, the first rope member 60 in one instance is a smaller diameter rope, since it is used only to spread apart the curved arm members 40 in preparation for engaging an individual with the rescue pole with clamping assembly 10. The second rope member 65 in one instance is a larger diameter rope, since it is used to close the curved arm members 40 around the body of an individual. In addition, the second rope member 65 is used, along with the linear pole member 15, to pull the individual to safety, once the rescue pole with clamping assembly 10 firmly engages that individual.

Figure 7:
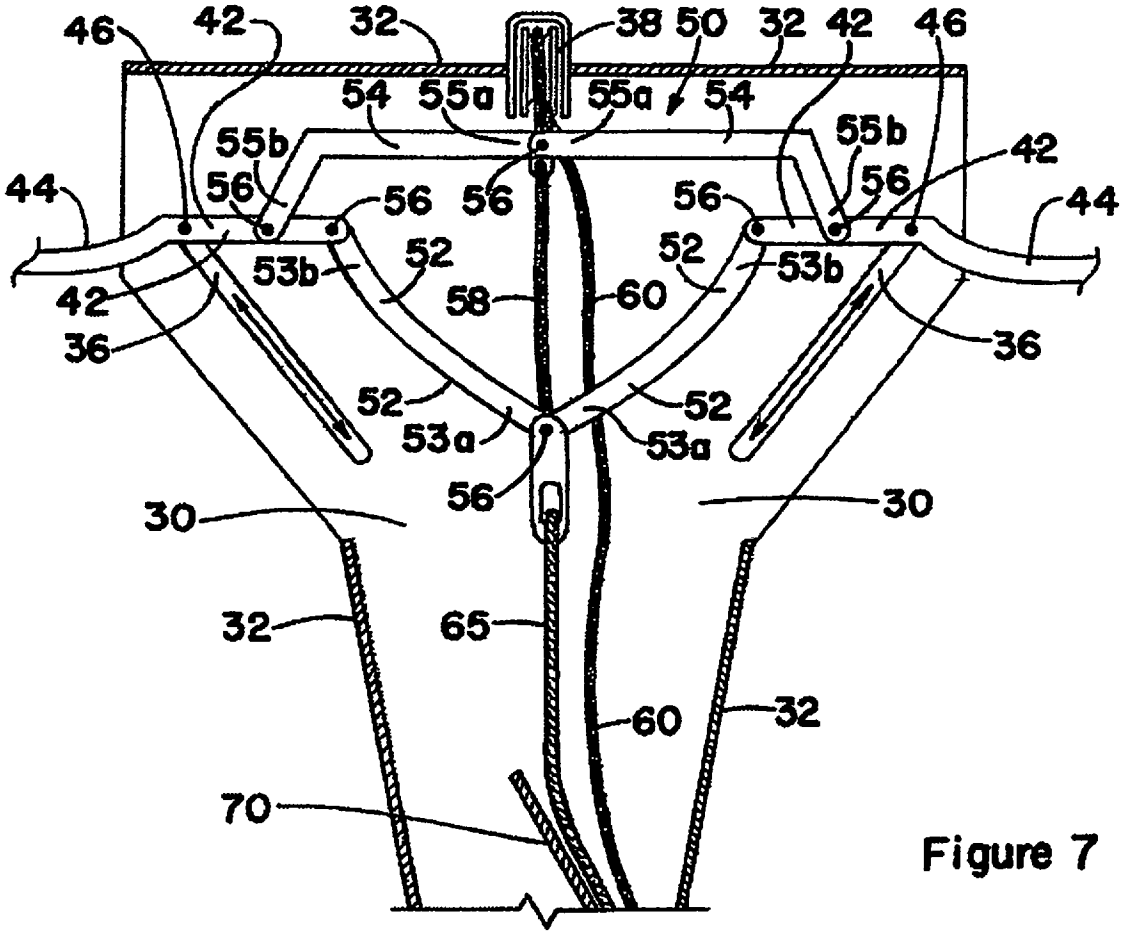
FIG. 7 is a top view of a part of a clamping mechanism portion of an aspect of the present invention in an open condition with one planar portion of the body member removed.
Figure 8:
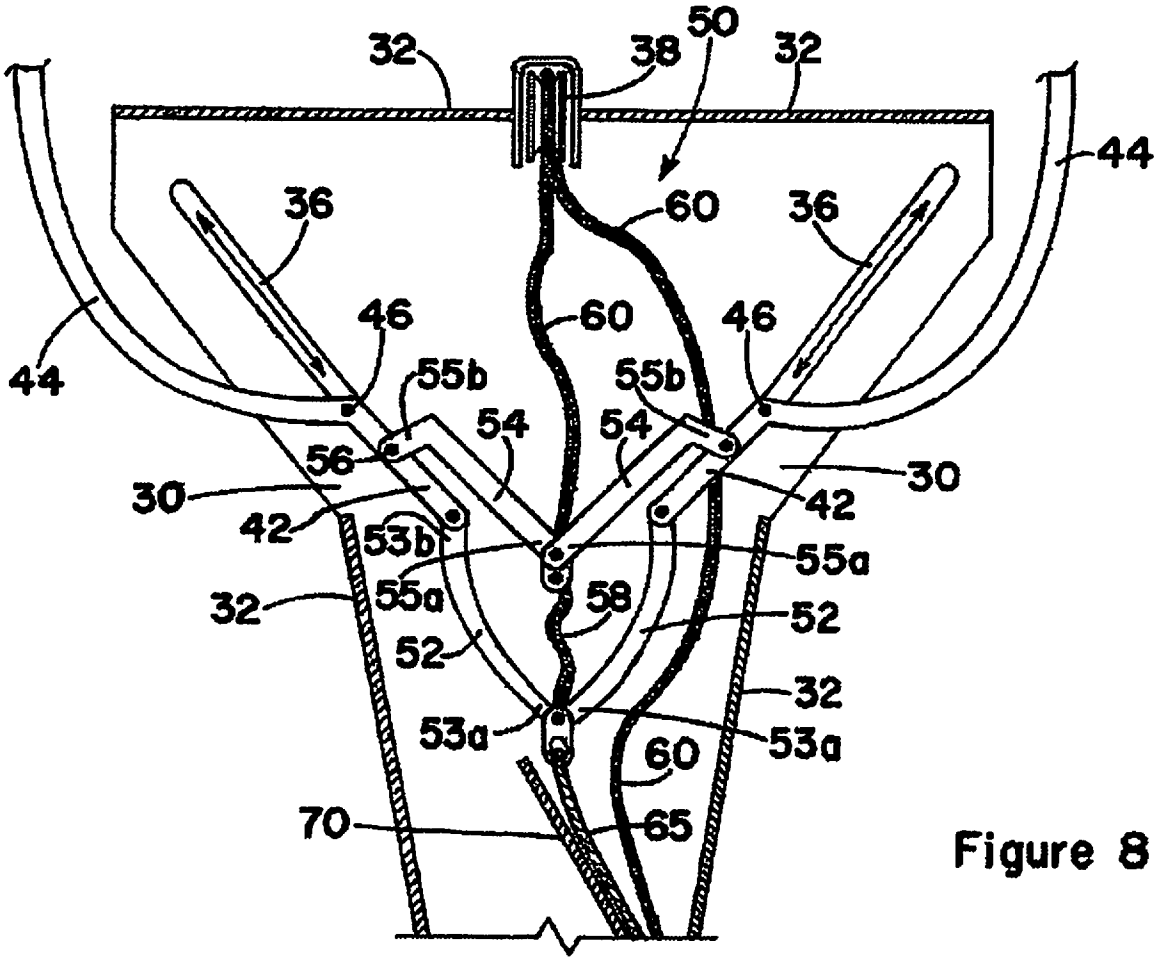
FIG. 8 is a top view of a part of a clamping mechanism portion of an aspect of the present invention in a closed or closing condition with one planar portion of the body member removed.

Referring now to FIGS. 7 and 8, an alternative aspect of the drive mechanism 50 or linkage is shown. The drive mechanism 50 within the hollow body member 25 is pivotally secured to the attachment end 42 of each arm member 40 there within. As shown in FIGS. 7 and 8, the drive mechanism 50 comprises a pair of first pivoting arms 52 pivotally joined together at each first end 53*a* by a pivot point connector pin 56. Each first pivoting arm 52 is pivotally connected at a second end 53*b* to the attachment end 42 of one curved arm member 40 at a point interior to the pin member 46. Another pivot point connector pin 56 provides the connection. In addition, a pair of second pivoting arms 54 is pivotally joined together at each first end 55*a* by another pivot point connector pin 56. Each second pivoting arm 54 is pivotally connected at a second end 55*b* to the attachment end 42 of one curved arm member 40 between the pin member 46 thereof and the pivotally attached first pivoting arm 52. A flexible link 58 is secured between the joined first ends 53*a* of the first pivoting arms 52 and the joined first ends 55*a* of the second pivoting arms 54. The flexible link 58 limits the distance between the connected first ends 53*a* of the first pivoting arms 52 and the connected first ends 55*a* of the second pivoting arms 54 when moving the drive mechanism 50 with either of the attached rope members 60, 65.

A pulley member 38 is rotatably mounted at an edge of the hollow body member 25 opposite the pole connector member 34 and between the pair of opposed curved arm members 40. A first rope member 60 is secured to the drive mechanism 50 at the pivot point connector pin 56 connecting the first ends 55*a* of the pair of second pivoting arms 54. The first rope member 60 at least partially encircles the pulley member 38 and extends from the body member 25 adjacent the pole connector member 34 (FIG. 1), or directly from the pulley member 38 (FIG. 5). A second rope member 65 is also secured to the drive mechanism 50, but at the pivot point connector pin 56 connecting the first ends 53*a* of the pair of first pivoting arms 52. The second rope member 65 extends from interior the body member 25 directly from the drive mechanism 50 and outside the body member 25 adjacent the pole connector member 34, as illustrated in FIG. 1.

Pulling the first rope member 60 draws the drive mechanism 50 and the attachment end 42 of each arm member 40 toward the pulley member 38 with the pin members 46 in the linear slots 36 moving to spread apart the curved ends 44 of the attached curved arm members 40 exterior the body member 25, as illustrated in FIG. 1. FIG. 7 illustrates the position of the second aspect of the drive mechanism 50, the attachment ends 42 of the curved arm members 40 and the pin members 46, with the curved arm members 40 wide open.

In one aspect, pulling the second rope member 65 draws the drive mechanism 60 and the attachment end 42 of each arm member 40 toward the pole connector member 34, with the pin members 46 in the linear slots 36 moving to bring together the curved ends 44 of the curved arm members 40 exterior the body member 25, as illustrated in FIGS. 3 and 5. FIG. 8 illustrates the position of a further aspect of the drive mechanism 50, the attachment ends 42 of the curved arm members 40 and the pin members 46, with the curved arm members 40 tightly closed.

Figure 9:
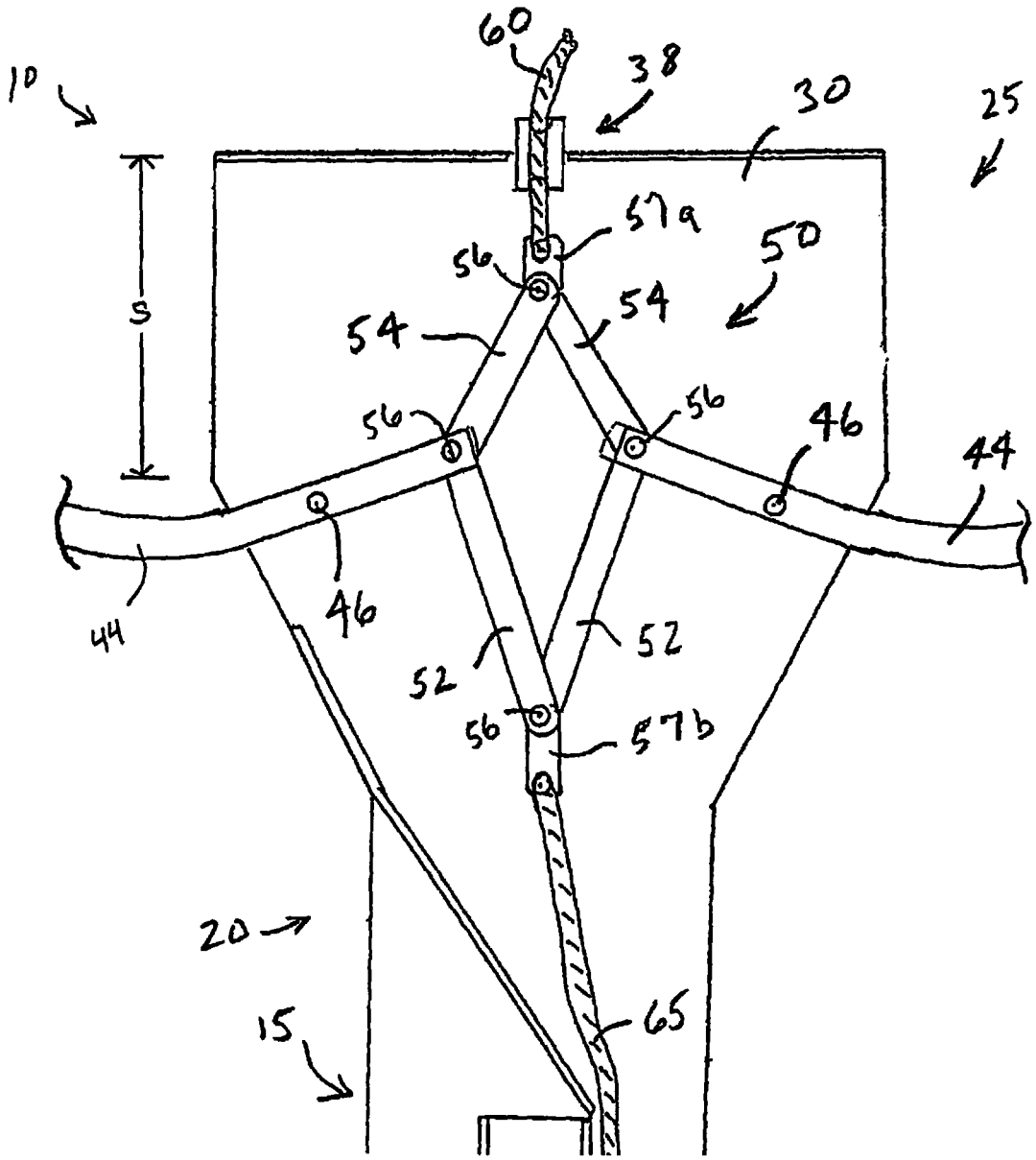
FIG. 9 is a top view of a part of a clamping mechanism of an aspect of the present invention in a closed or closing condition.
Figure 10:
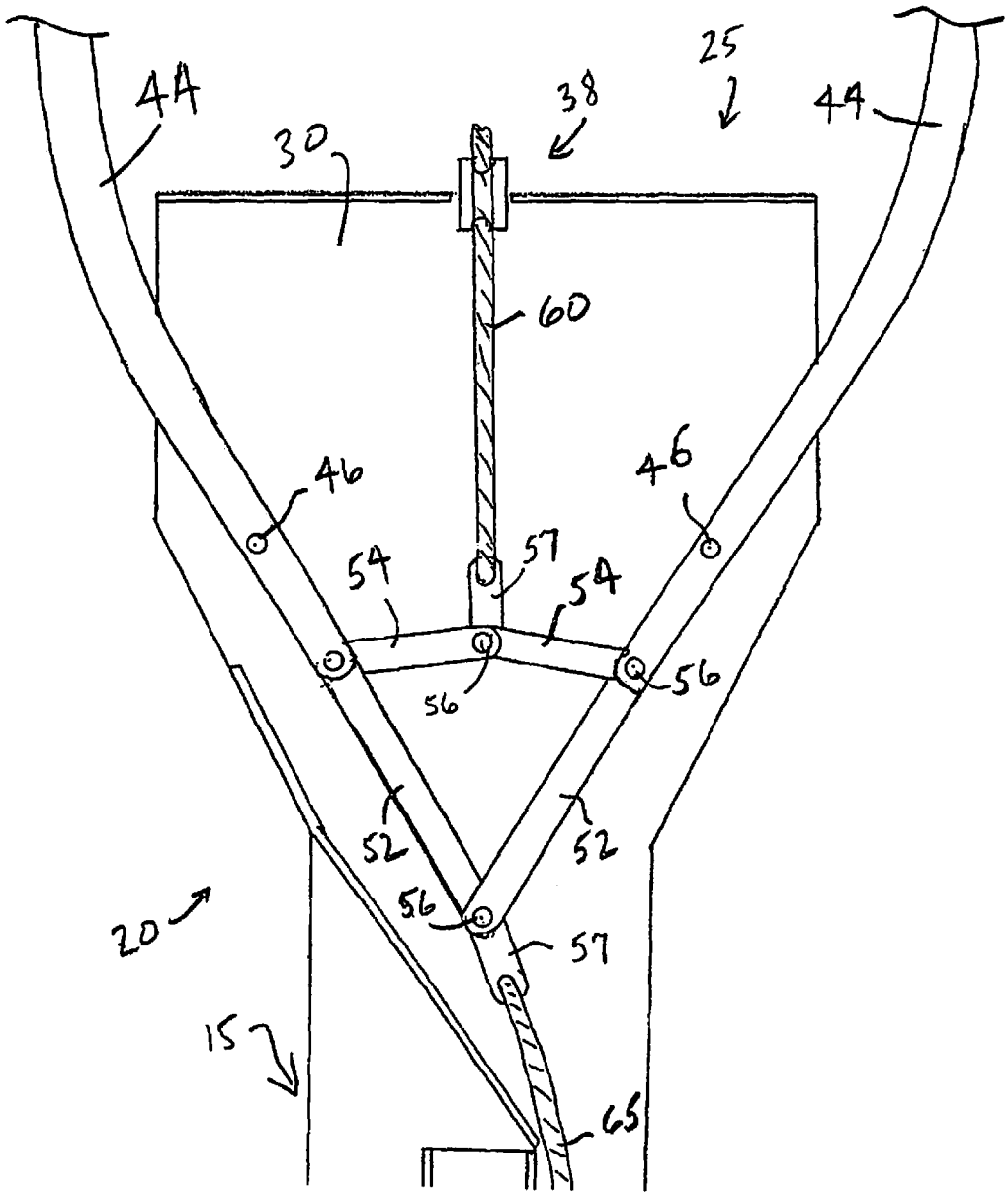
FIG. 10 is a top view of a part of a clamping mechanism of an aspect of the present invention in an open or opening condition.

In a further aspect as shown in FIG. 9 and FIG. 10, rescue pole 10 includes a pole member 15 having a clamping mechanism 20 disposed at one end of the pole 15. Clamping mechanism 20 includes two opposed arm members 44, 44 pivotally connected to a body member 25. Arm members 44, 44 may be curved. Arms 44 are configured to be activated by a rope 65 such that pulling on the rope 65 causes the arm members 44 to close together. Pole 10 may include a planar section 30, or a pair of opposed planar sections 30 which create a space for containing drive mechanism or linkage 50. FIG. 9 and FIG. 10 show pole 10 with a single planar section 30 showing. In one aspect the paired planar section 30 is removed from the view for clarity. In one aspect a pulley mechanism 38 is positioned opposite pole member 15. For example pulley mechanism may be positioned at or toward a terminal end of pole 10. Arm members 44 are configured to be activated by a rope member 60 disposed upon pulley mechanism 38. Pulling on rope member 60 causes arms 44 to spread apart.

In this particular example, a linkage 50 may include a first pair of pivoting arms 52 pivotally connected to arms 44 at pivot pins 56. A second pair of pivoting arms 54 may also be pivotally connected to arms 44. Arms 54 may also be connected at pivot pins 56. A link plate 57 may be included to extend from linkage 50 to provide for connection to rope 65, for example by having an aperture or other connecting means through which rope 65 may be connected. Another link plate 57 may also be included so that rope 60 may be secured to linkage 50. It may be appreciated that rope 60, 65 may be connected directly to pivoting arms 52, 54, or even directly to arms 44 in an appropriate variation. It may be appreciated that arms 44 are pivotally connected to pole 10 by use of pivot pins 46. In one example pivot pins 46 may be connected to body 25. In one instance, pivot pin is positioned a first distance from pole member 15 which distance has a measure less than a measure of a distance from the pole member 15 to pulley mechanism 38. Such arrangement provides for a pulling action away from pole member 15 while a user grasps pole member 15 and pulls upon rope 60. It may be appreciated that pulley mechanism 38 includes pulley means, which may include, for instance, a pulley, a rotating shaft, a rotating wheel, a sleeve or other rotating apparatus which allows for smooth motion of rope 60 when pulling upon linkage 50.

As may be appreciated with reference to FIG. 9, planar section 30 includes a space "S" (represented by the arrow "S"). Space "S" allows for pulley mechanism 38 to be separated a further distance from pivot pins 46 to accommodate a more efficient separation action of arms 44 when pulling on rope 60. The extra space "S" (or placement of pulley 38 further from pins 46) allows for mechanical advantage when pulling rope 60 (See also, for instance, rope 60 in FIG. 10, and the relation of link plate 57 with respect to pins 46). By comparison with the aspects shown in FIG. 2, for instance, positioning pulley mechanism 38 a further distance from pins 46 allows for mechanical advantage and a smooth opening of arms 44 (without worry of whether pins 46 slide or catch within slots 36 as in FIG. 2).

Figure 11:
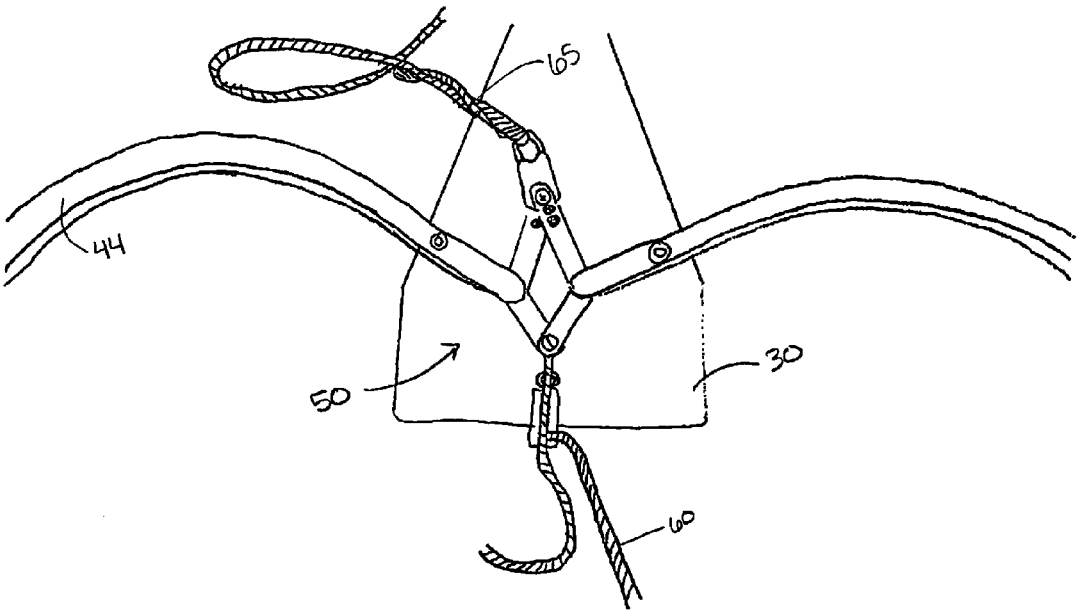
FIG. 11 is a partial front perspective view of a component of the rescue pole in accordance with an aspect of the invention, having a linkage of the rescue pole exposed for clarity.
Figure 12:
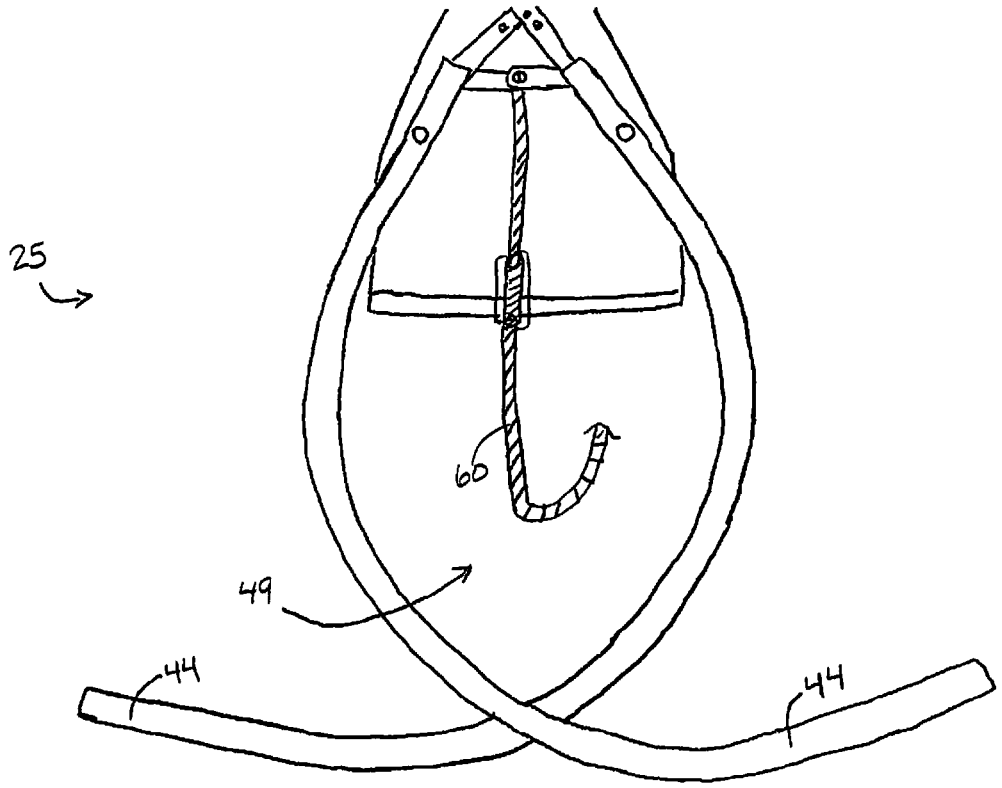
FIG. 12 is a partial front perspective view of a component of the rescue pole in accordance with an aspect of the invention, having a linkage of the rescue pole exposed for clarity and depicting a closed or closing condition.

Referring to an example in FIG. 11 and FIG. 12, pole 10 is shown with planar section 30 removed. FIG. 11 depicts arms 44 in an open position where arms 44 are spread wide. It may be appreciated that rope 60 was pulled so that linkage 50 was extended away from pole 15. In one instance rope 60 pulls linkage 50 such that link plate 57*a* (or associated pivot pin 56) is positioned closer to pulley mechanism 38 as compared to pin members 46. FIG. 12 depicts arms 44 in a closed position where arms 44 abut and/or overlap each other. It may be appreciated that rope 65 was pulled so that linkage 50 was drawn toward pole 15. In one instance rope 65 pulls linkage 50 such that link plate 57*a* (or associated pivot pin 56) is positioned closer to pole member 15 as compared to pin member 46. It may be appreciated that linkage 50 may include a variety of different configurations or mechanisms to achieve the separation and closing action of arms 44.

Figure 13:
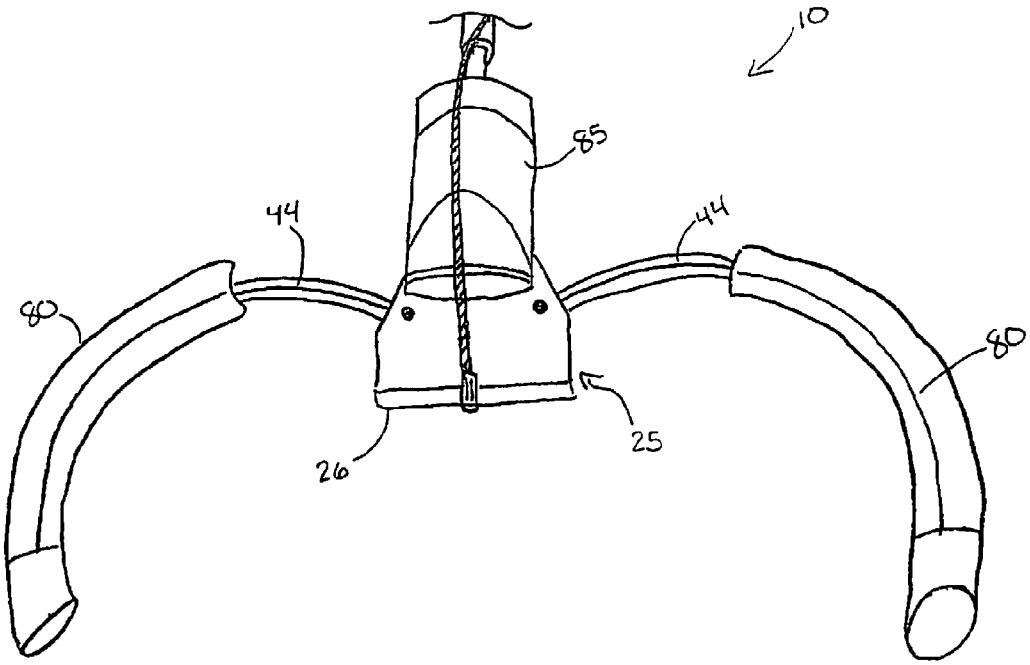
FIG. 13 is front perspective view of a component of the rescue pole in accordance with an aspect of the invention, having depicting an open or opening condition.
Figure 14:
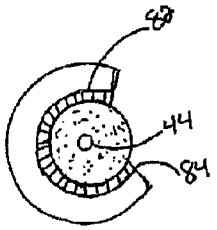
FIG. 14 is a section view in accordance with a further aspect of the invention.

FIG. 13 shows pole 10 having floatation member 80 affixed to arms 44. Pole 10 also includes floatation member 85 associated with body 25. Floatation member 80 can be of many varieties and in one instance is made of floatable cellulose material configured for use by persons to assist with floatation while present in a body of water, such as a pool, lake, stream, river or other water source. In one aspect float member 80 includes an indicator color that is bright and visible to assist a user of pole 10 and/or a person to be rescued in location of arms 44. Float member 80 serves a further purpose of acting as a cushioning device for a victim so that the victim can have a more comfortable grip when pole 10 is in use. Floatation member 80 serves yet a further purpose in that it provides enhanced thickness to assist a victim in grasping arms 44. Particularly the thickness is such that a it may be convenient positioned around a torso or chest area and underneath the armpit of the victim. The buoyancy and padding may calm the victim. In one aspect the thickness of float member 80 is such that a layer of the float 80 is at least twice as thick as the largest cross-section thickness of arm 44 as generally shown in FIG. 14. In may be appreciated that a cross section of arm 44 may be circular, square or other configuration. In a further aspect, a float addition 82 may be added to float 80. Particularly, float addition 82 may be a planar piece of float material that can wrap, at least partially around or about float 80. In one aspect a hook-and-loop type of fastener 84 may be used to secure float addition 82 to float 80. It may be appreciated that other fastener mechanisms may be used without departing from the invention. Addition 82 may cover float 80 along an entire length of float 80 or may cover a portion of float 80 as desired. Addition 82 provides enhanced thickness to arm 44. An arm with enhanced thickness is useful, for instance, in assisting the rescue of smaller individuals, including children who have a torso area much smaller/thinner than a typical adult. It may be appreciated, with reference to FIG. 12, that arm 44 equipped with float 80 and/or addition 82 may provide a very thick arm 44 such that a central area 49 created by overlapping arms 44 can be narrowed so that pole 10 can be used to rescue smaller individuals. A user may add or removed addition 82, or a variety of thicknesses of addition 82, to accommodate a particular rescue situation. The addition 82 also provides for further floatation and buoyancy.

It may be appreciated that arms 44 may abut each other upon closing or may also overlap each other as generally shown in FIG. 12.

Referring to FIG. 13 a float member 85 may be disposed on body 25. Float 85 provides additional buoyancy for pole 10. Float 85 also protects body 25 and provides a softer surface as compared to an exposed planar member 30 or other parts that may be made of metal. Float 85 may also be of a similar indicator or color as float 80 or addition 82, or may comprise a separate indicator to provide a more noticeable aspect.

With further reference to FIG. 13 it can be seen that pulley mechanism 38 may be accessed through a port in body 25. In one instance mechanism 38 may be inset within a distal edge 26 of body 25. Rope 60 may extend from within body 25 and be oriented toward a user that holds pole member 15.

In one aspect, all components of the clamping mechanism 20 are fabricated from a steel alloy or other metal for strength and durability. It may be appreciated that the mechanism and the linear pole member 15 may be fabricated from a variety of other materials, including lighter weight material, such as aluminum, fiberglass or polymeric resin, such as PVC, or composites or other metals and also plastics. A telescoping pole member 15 is commercially available form numerous sources. In some cases the pole segments will twist within an adjacent pole to accommodate adjustment and tightening. In other cases the pole segments may include spring tabs that protrude through apertures in a nesting pole segment to lock the segments into position. A user may depress a spring tab or detent from an aperture to effectuate release of a segment for adjustment within a nested segment.

In a method aspect of the invention a user may utilize pole 10 to rescue a person. In one instance the method 110 includes pulling on a rope 65 affixed to clamping mechanism 20 which is disposed at an end of a pole, such as a pole 15. Clamping mechanism 20 includes tow opposed pivoting curved arm members 44 that extend toward and grasp the person upon pulling the rope 65. Particularly, for instance, a user may position pole 10 adjacent a victim who has fallen through the ice. A user may pull rope 65 when arms 44 are positioned so that arms close upon a torso of the victim. The victim may grasp arms 44 which are covered with floatation material 80. One a victim has been grasped by pole such as pole 10, the use may continue to pull on rope 65 to transport and pull the victim toward the user. In one instance a user may walk away from the victim while holding rope 65. This walking action will pull victim along and through, over or across the water (or ice, or other hazard or material) to a position of safety. This allows for rescue while the user is positioned at a relatively safe distance from the victim and hazard. In a further aspect of method 110, the clamping mechanism 20 includes a pulley mechanism 38. The method further includes utilizing a second rope associated with the pulley to spread apart the arms 44 prior to closing the arms 44 to capture or grasp a victim. A user may adjust the length of pole 15 as needed. A long length of rope 60, 65 may be used to accommodate for different lengths of telescoping pole 15.

While the invention has been particularly shown and described with reference to preferred embodiments thereof, it will be understood by those skilled in the art that various changes in form and details may be made therein without departing from the spirit and scope of the invention.

What is claimed is:

1. A rescue pole comprising:

a linear pole member having a clamping mechanism disposed at one end of said pole member, said clamping mechanism comprising:

two opposed arm members pivotally connected to a body member and configured to be activated by a first rope member such that pulling on the first rope member causes said arm members to close together; and a pulley mechanism positioned opposite said pole member, said arm members configured to be activated by a second rope member disposed upon said pulley mechanism such that pulling on said second rope member causes said arms to spread apart.

2. The rescue pole of claim 1 further including a linkage mechanism linking said arms together, said first rope member connected to said linkage mechanism.

3. The rescue pole of claim 2 where said second rope member is connected to said linkage mechanism.

4. The rescue pole of claim 1 where each of said arm members is curved and is pivotally connected to said body with a pivot pin, said pivot pin positioned a first distance from said pole, said pulley mechanism includes a pulley connected to said body at a second distance from said pole, said second distance greater than said first distance.

5. The rescue pole of claim 1 where said arms are disposed between opposed planar sections.

6. The rescue pole of claim 5 where said planar sections are connected by sidewall sections to form a hollow interior.

7. The rescue pole of claim 6 where said arms extend from said hollow interior.

8. The rescue pole of claim 1 further including a floatation member disposed on at least one of said arms.

9. The rescue pole of claim 8 comprising a floatation member disposed on each of said arms, said arms configured to abut upon pulling on said first rope member.

10. A method of rescuing a person comprising the step of utilizing the rescue pole according to claim 1.

11. The method of claim 10 where said utilizing includes closing about the person each of said two curved pivoting arm members by pulling on said first rope and further pulling on said first rope to transport the person to safety.

12. A rescue pole comprising:

a linear pole member having a clamping mechanism disposed at one end of said pole member, said clamping mechanism comprising:

two opposed arm members configured to be pivotally activated by a first rope member such that pulling on the first rope member causes said arm members to close together, each of said arm members including a floatation member.

13. The rescue pole of claim 12 where said arms are curved and are configured to abut upon pulling said first rope.

14. The rescue pole of claim 13 where said arms are configured to overlap upon pulling said first rope.

15. The rescue pole of claim 12 where said arms are disposed between opposed planar sections.

16. The rescue pole of claim 15 where said planar sections are connected by sidewall sections to form a hollow interior, said arms extend from said hollow interior.

17. A method of rescuing a person comprising:

pulling on a rope affixed to a clamping mechanism disposed at the end of a pole, the clamping mechanism having two opposed pivoting arm members that extend toward and grasp the person upon pulling the rope, said method further comprising utilizing a second rope to spread apart the pivoting arm members.

18. The method of claim 17 where the person is in a water environment, said method further including walking away from the person while continuing to pull the rope.

19. The method of claim 18 where the clamping mechanism includes a pulley, said utilizing a second rope is associated with the pulley to spread apart the arms prior to grasping the person.

20. The method of claim 19 where a floatation member is disposed on each of the arms, the arms configured to abut upon pulling on the first rope member.

* * * * *